US005766726A

United States Patent [19]

Bannister

[11] Patent Number: 5,766,726

[45] Date of Patent: Jun. 16, 1998

[54] FLEXIBLE PLASTIC EDGE STRIP FOR FLOOR COVERING THRESHOLDS

[76] Inventor: Toni P. Bannister, 709 Peterson Rd. #3, Burlington, Wash. 98233

[21] Appl. No.: 927,310

[22] Filed: Sep. 11, 1997

Related U.S. Application Data

[63] Continuation of Ser. No. 628,460, Apr. 5, 1996, abandoned.

[51] Int. Cl.[6] ..... A47G 27/04

[52] U.S. Cl. ..... 428/119; 428/131; 428/192; 16/7; 16/16; 52/717.03; 52/717.05

[58] Field of Search ..... 428/119, 131, 428/192; 16/1 R, 7, 16; 52/179, 287.1, 717.03, 717.05

[56] References Cited

U.S. PATENT DOCUMENTS

| | | | |
|---|---|---|---|
| 1,769,283 | 7/1930 | Awbrey | 16/7 |
| 2,258,314 | 10/1941 | Bonnell | 16/7 |
| 2,644,977 | 7/1953 | June | 16/7 |
| 2,892,208 | 6/1959 | Stock | 16/16 |
| 2,980,943 | 4/1961 | Barnes et al. | 16/7 |
| 3,528,122 | 9/1970 | Fuller et al. | 16/16 |
| 4,478,017 | 10/1984 | Brown et al. | 52/209 |
| 5,475,953 | 12/1995 | Greenfield | 52/179 |

*Primary Examiner*—Alexander Thomas
*Attorney, Agent, or Firm*—Todd N. Hathaway

[57] ABSTRACT

A resilient, semi-rigid molding strip for installation along an edge of a linoleum floor surface, particularly suited to installations where the edge follows a curved contour. The molding strip is formed from extruded semi-rigid vinyl. There is a horizontal top flange and a vertical web having an angled nailing surface along its lower edge. The nailing surface correctly aligns the fasteners, and the web section is drawn downwardly during installation so that the top flange is resiliently biased against the linoleum surface. The characteristics of the semi-rigid material permit the strip to be bent in the horizontal plane without buckling the top flange or footing section of the web.

28 Claims, 2 Drawing Sheets

FLEXIBLE PLASTIC EDGE STRIP FOR FLOOR COVERING THRESHOLDS

This application is a continuation of application Ser. No. 08/628,460 filed on Apr. 5, 1996 now abandoned.

BACKGROUND OF THE INVENTION a. Field of the Invention

The present invention relates generally to residential and commercial floor coverings, and, more particularly, to a flexible trim strip for covering the edges of linoleum surfaces where these transition to carpeted areas.

b. Background

Trim strips are frequently installed to cover the edge of linoleum floor surfaces where these transition to carpeted areas, such as at the entrance to a kitchen or bathroom. The trim strip goes over the edge of the lineoleum to hold this down and protect it from traffic wear, and also to provide a more finished appearance.

Most edge strips which have previously been available to the residential construction industry have been unattractive aluminum members. In addition to providing an unsatisfactory appearance, these conventional metal strips exhibit a number of other deficiencies. For example, because the material is not resilient in character, the strip is unable to conform to even slight irregularities in the linoleum material and often forms a poor fit with this surface, which is both untidy and permits dirt to collect in this area. Also, the metal strip material is subject to permanent deformation damage (i.e., denting) if something heavy strikes or rolls across its upper surface. Furthermore, conventional aluminum trim strip materials cannot be fitted in installations where the edge of the lineoleum area follows a curved contour, rather than a straight threshold. Moreover, to the extent that such aluminum strip materials have any sort of coloration/decoration to help the material match the interior decor of the residence, this is usually in the form of an anodized color or other surface layer; under the traffic and wear and tear of a normal home, this surface layer quickly wears off, exposing the underlying aluminum color and presenting an uneven, unsightly appearance.

In addition to the aluminum trim strip materials described in the preceding paragraph, a few edge strip materials formed of plastic have existed. However, the majority of these are designed for commercial installations and lack features which would be necessary for use in a home environment. Moreover, because of their structural characteristics and material, none of the known plastic edge strips is suitable for bending in a horizontal plane, with the result that these cannot be effectively fitted to curved or contoured interfaces between carpeted and linoleum floor areas. For example, most known plastic edge strips, which are designed for commercial installations, have a wide upper flange which resists bending in the horizontal plane and tends to buckle if forced.

In addition to the deficiencies described above, installation of the known edge strip materials is generally labor-intensive, adding to construction costs. For example, the aluminum strip materials normally require precise measuring and cutting with a saw in order to form a satisfactory fit; also, improper installation of the fasteners (i.e., nails or screws) can cause misalignment between the upper flange of the strip and the linoleum surface. Most known plastic strips, in turn, are somewhat difficult to work with in getting the nail/screw started, which again slows down the installation.

Accordingly, there exists a need for a trim strip for use between linoleum and carpeted areas which is formed of a material which is suitable for use in residential construction and which can be installed along curved, contoured thresholds. Moreover, there exists a need for such a trim strip which is inexpensive to produce and durable in service. Still further, there is a need for such a trim strip material which is easy and quick to install, thereby minimizing labor costs.

SUMMARY OF THE INVENTION

The present invention has solved the problems cited above, and is an elongate molding strip for installation along an edge of the linoleum floor. Broadly, this comprises: (a) a web section for extending in a generally vertical direction along an edge of a lower underlayment layer of the floor, (b) a flange section mounted to an upper portion of the web section for extending in a generally horizontal direction along a surface of a linoleum layer on top the underlayment layer, the upper flange section extending forwardly from the web section at a slight downward angle, and (c) a footing section mounted to a lower portion of the web section for receiving nails, screws, or like fasteners, the footing section being configured to draw the web section downwardly as the fasteners are driven therethrough to install the strip, the molding strip being formed of a semi-rigid, resilient flexible material having a selected hardness such that the flange section flexes upwardly to a substantially horizontal orientation in which this is resiliently biased against the top of the linoleum layer, and such that the molding strip bends in a horizontal plane so as to conform to an edge of a linoleum floor which follows a curved contour, without buckling of the flange or footing sections.

The molding strip may further comprise a corner section which joins the horizontal flange section to the vertical web section, the corner section having a radiused outer surface which minimizes the concentration of stress and for enhanced resistance to traffic wear. The upper flange section may taper outwardly from a relatively thick base portion at the radiused corner section to a relatively thin tip portion which extends over the linoleum layer, so that the relatively thick base portion has sufficient strength to firmly bias the flange section against the linoleum layer while the relatively thin tip portion presents a minimized protrusion above the linoleum layer. The relatively thin tip portion of the flange section may have a radiused upper surface for enhanced resistance to traffic wear.

Preferably, the web section and footing section have a combined height which is equal to or less than a combined height of the linoleum layer and the underlayment layer.

The footing section preferably comprises an outer face portion which extends outwardly and downwardly from the vertical web section so as to form an area of thickened material in said footing section. The outer face portion of the footing section may comprise a substantially planar surface which extends outwardly and downwardly from the vertical web section at a selected angle. This selected angle is preferably substantially perpendicular to a predetermined correct angle for installation of the nails or other fasteners so as to aid in correctly orienting the fasteners for driving these through the footing section and the underlayment layer of the floor. Furthermore, the footing section may further comprise a plurality of pre-formed bores extending at a substantially perpendicular angle to the surface for passage of the fasteners therethrough. Each of these bores may have an exit opening located so that this will be positioned at a predetermined height above a bottom of the underlayment layer, so as to avoid breakage of the underlayment layer as the fasteners are driven therethrough.

The angle at which the planar surface extends outwardly and downwardly from the web section is furthermore preferably substantially parallel to a predetermined angle at which an undercut section of a carpet hold-down strip slopes inwardly and downwardly when this is installed proximate the floor edge, so that the footing surface and the undercut section define a sloping, parallel-sided channel into which the carpet edge can be tucked during installation. Preferably, this angle is approximately 30° from vertical.

The footing section may further comprise a bottom surface which slopes upwardly and rearwardly at a predetermined angle so as to form a gap above an underlying subfloor which permits the footing section to deform downwardly during the installation of fasteners therethrough, so as to assist in drawing the wall section downwardly as the fasteners penetrate the footing section. Preferably, the angle at which the bottom surface of the footing section extends upwardly and rearwardly is substantially parallel to the angle at which the flange section extends forwardly and downwardly from the web section. This angle may be approximately 5° from horizontal.

The semi-rigid, resiliently flexible material is preferably an extrusion-molded semi-rigid vinyl material. Preferably, this has a hardness in a range from about 58 Shore D to about 68 Shore D. The width of the flange section may be approximately equal to the combined height of the web and footing sections, and the rigidity of the material is preferably in the range from about 62 Shore D to about 66 Shore D. For half-inch width and height, the rigidity may preferably be about 63 Shore D.

DETAILED DESCRIPTION a. Overview

Figure 1:
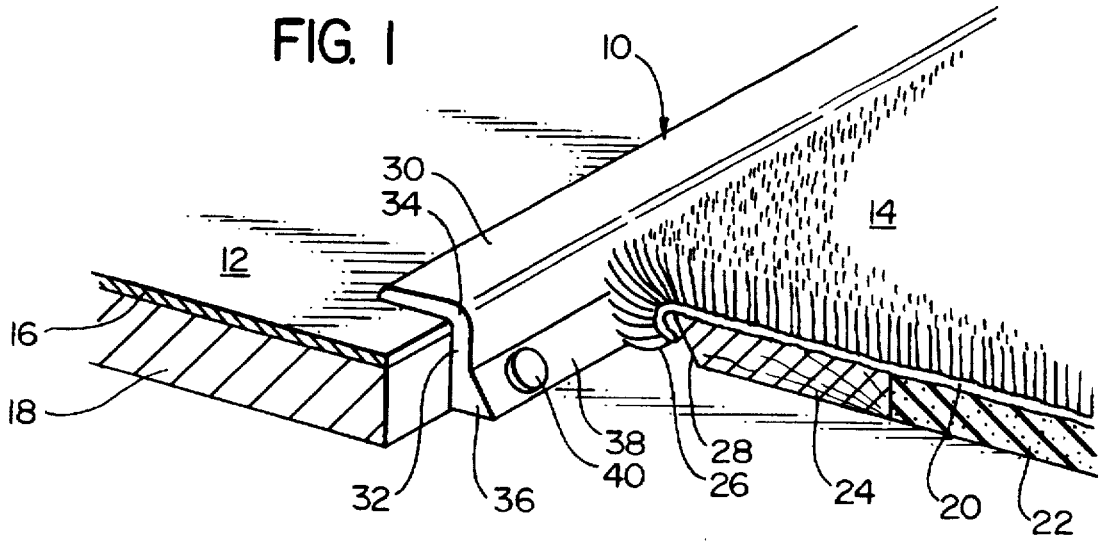
FIG. 1 is a perspective view of an edge strip in accordance with the present invention installed over the edge of a linoleum-covered area where this transitions to a carpeted area.

FIG. 1 shows a section of edge strip material 10 in accordance with the present invention installed between a linoleum floor surface 12 and a carpeted area 14. As can be seen, the comparatively thin layer of linoleum 16 is mounted on top of a comparatively thick plywood or particle board underlayment 18. This form of construction is conventional for residential building, with the normal thickness of the underlayment being one-half inch. Also, it should be noted that the term "linoleum", as used in this description and the appended claims, includes all of the various thin-layered, generally smooth-surfaced and usually somewhat flexible floor coverings which are generally referred to by this term in the relevant art.

In the carpeted area, in turn, the carpet pile/backing is installed over a cushioning pad 22 (typically 7/16–½ inch). At the transition to the linoleum area, the carpet is attached to a nail-downed wooden hold-down strip 24 (again, typically one-quarter inch thick), with the actual edge 26 of the carpet being tucked under an undercut bevel along the outer edge of the hold down strip.

As can be seen with further reference to FIG. 1, the edge strip 10 of the present invention is mounted along the joint between the carpeted and linoleum areas. The edge strip has an upper flange section 30 which extends over the edge of the linoleum surface, and a vertical web section 32 which extends vertically down the front edge of the linoleum and underlayment layers, this being joined to the upper flange section at a radiused corner 34.

Towards the bottom of the vertical web section 32, there is a somewhat thickened footing section 36 having a somewhat triangular cross-section and an outwardly sloped face 38. As will be described in greater detail below, this outwardly angled face facilitates proper alignment and installation of nails 40 or other suitable fasteners.

The edge strip material is supplied in any suitable length, with twelve foot lengths being eminently suitable and corresponding to the standard lengths in which edging materials are conventionally supplied in the industry.

As will also be described in greater detail below, the edge strip material is preferably formed of a resilient, semi-rigid plastic material, which enables it to be conveniently installed along curved edges. The combination of the material characteristics and the configuration/dimensions of the edge strip permit this to be done without excessive deformation or buckling of the top flange. Also, the resilient nature of the material enables it to spring back from heavy impact without permanent damage. Moreover, the coloring of the edge strip, which is supplied in shades to compliment the interior colors of the residential dwelling, extends throughout the extruded material of which the strip is formed, so that there is no possibility of this wearing off due to extended use or abrasion.

b. Structure

Figure 2:
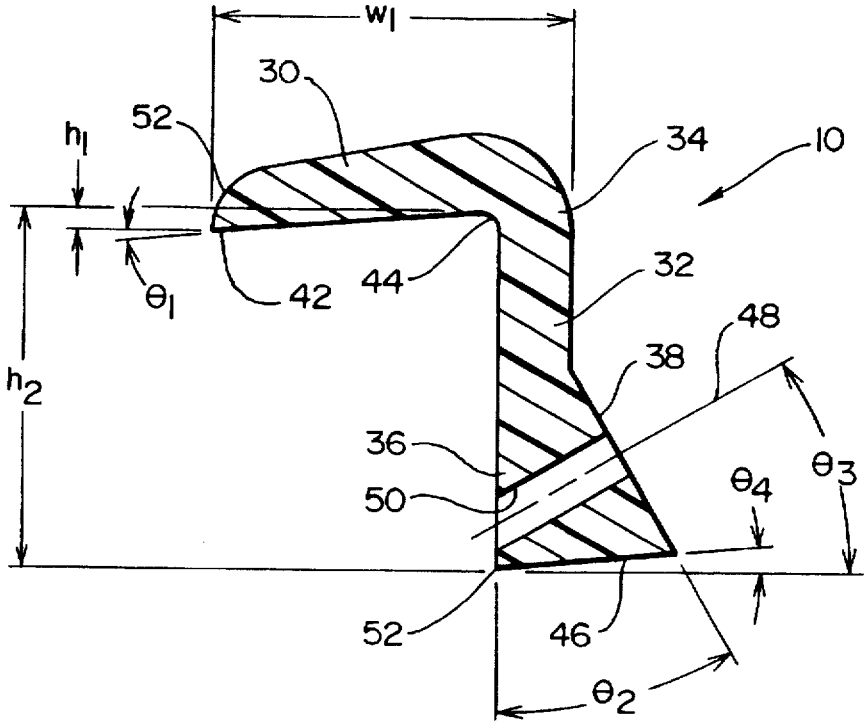
FIG. 2 is an end view of a cross-section taken through the edge strip material of FIG. 1, showing the profiles thereof and the angled surface of the footing portion thereof which assists in the proper alignment/installation of the nails or other fasteners.

FIG. 2 shows an end view of a cross-section taken through the edge strip material 10, this being somewhat enlarged from the view shown in FIG. 1 so as to show the structural features thereof in greater detail.

As was briefly noted above, the dimensions, proportions, and angles of the features of the edge strip are important in that these cooperate with the characteristics of the preferred extruded semi-rigid vinyl material to provide the present invention with its advantages in terms of ease of installation, tightness of fit, and so on. For example, FIG. 2 shows that, in its original condition, the upper flange 30 extends at an angle which is depressed somewhat below horizontal, by an angle $\theta_1$; preferably, the angle $\theta_1$ is approximately 5° below horizontal, with a range from about 3° to 7° being suitable, and the range from about 1° to 10° may be acceptable for some embodiments. As a result of the depressed angle, the outer lip 42 is positioned a vertically-spaced height $h_1$, below the level of the lower surface of a flange at the inner corner 44; in the embodiment illustrated, the height $h_1$, may be, for example, approximately 0.025 inch. The width $w_1$, of the top flange 30 is preferably in the range of approximately 0.490 inch–0.510 inch (e.g., one-half inch) in the embodiment which is illustrated; this width provides a sufficient coverage/protection for the edge of the linoleum surface, it also avoids any tendency of distortion or bending up when the strip is installed along a curved edge.

The inside height $h_2$, from the inside corner 44 of the strip to the bottom of web section 32, is approximately equal to the height of the underlayment; using the exemplary material described below, a thickness of approximately 0.10 inch has been found suitable for the material of web section 32. For example, for use with a standard one-half inch underlayment, as described above, $h_2$ is preferably in the range from 0.475 inch–0.500 inch (e.g., one-half inch). Moreover, it is important that the height $h_2$ be no more than the height of the underlayment, since this would interfere with the correct insulation of the edge strip, as will be described in greater detail below.

About halfway down the outer surface of web 32, wall 38 slopes outwardly to form the thickened footing section 36. For reasons which will be descried in greater detail below, the angle $\theta_2$ of the sloping outer wall is preferably approximately 30° from perpendicular, although angles in the range from about 10° to about 60° may be suitable for some embodiments. The 30° angle subtends a footing bottom surface 46 which is approximately 0.245 inch–0.255 inch wide (e.g., one-quarter inch wide).

The thickened material of the footing section provides enhanced strength in this area for the nails or other fasteners. Also, the axes 48 of the pre-formed bores 50 for the fasteners preferably extend perpendicular to the sloping surface. Hence, the angle $\theta_3$ of the bores above horizontal is equal to the angle $\theta_2$, i.e., approximately 30°–35°. As will be described in greater detail below, this angles ensures correct insulation of the nails/fasteners. Also, the alignment of the fastener bores 50 are perpendicular to the sloped wall 38 makes it very easy for the installer to correctly align the nail and drive these home in a minimum of time. The inner end of the bores 50 exit a spaced distance, preferably approximately 1/16th inch, above the bottom and side corner 52 of the footing section, reducing the chance that the particle board material will chip off or fracture as the nails are driven through it. The bores at provided at suitable spacings along the length of the head strip, preferably at approximately 5-inch centers. As used in this description and the appended claims, the term "fastener" includes nails, ring-shank nails, screws, brads, staples, and like fasteners.

The bottom surface 46 of the fitting, in turn, is not horizontal, but instead is preferably sloped rearwardly and upwardly at an angle $\theta_4$ which is approximately equal to the downwardly sloped angle $\theta_1$ of the top flange section 30, i.e., approximately 5°. As will be described in greater detail below, this enables the resilient material of the footing section to deflect downwardly during installation of the nails or other fasteners through bores 50, pulling the web section 32 downwardly and forcing the top flange into a horizontal alignment against the upper surface of the linoleum.

The thickness of the upper radiused section 34 is important in this regard, since (in additional to providing long term durability), it must provide sufficient resistance to bending that this resilient biases the underside of the flange into a tight-fitting contact with the linoleum surface. Using the material which will be described in greater detail below, the thickness of material in radius section 34 is approximately 0.11 inch in the embodiment which is illustrated and is preferably within the range from about 0.00 inch–0.15 inch. Preferably the outside radius of this section is approximately 0.125 inch. It should be noted that if material in this area is too thick, this will protrude extensively above the floor surface, resulting in excessive wear. The smoothly radiused upper contours of the radius section 34 and the radiused tip area 52 of the flange provide enhanced wear characteristics and a reduced chance of traffic catching on the edges of this strip, and also provide an aesthetically superior installation. It should also be noted that the radiused surface 52 at the outer tip of the flange preferably meets the planar underside at tip 42 at an angle of no more than 90°, so as to eliminate any "undercut" in this are which could cause the accumulation of dirt. Also, to insure a tight-fitting installation, the thickness of the top flange 30 tapers somewhat from the radiused corner 34 towards the tip area 52.

c. Material

As was noted above, the material of which the edge of the present invention is formed is resiliently flexible, so that this can conform to curved-line thresholds. At the same time, it has been found that for efficient installation, the material should not be excessive "flexible or springy". In other words, the installer should be able to bend the material to fit the contour and than this will retain its shape of the fasteners on being installed, without requiring the installer to hold the strip in place with his other hand or a clamp or some other form of securing means.

A material which is eminently suitable for use in the present invention and which exhibits these characteristics is an extruded semi-rigid vinyl (PVC) material having a durometer (Shore) hardness of approximately 63 Shore D. A material of this type, is for extrusion molding, is available under the trademark "Geon" (registered) vinyl from The Geon Company, 6100 Oaktree Blvd, Cleveland, Ohio.

The term "Shore Hardness", lay terms, is a measure of the "rigidity" of the material. As noted in the preceding paragraph, a hardness of 63 Shore D has been found preferably for the present invention, and a range from about 62 to about 66 Shore D is suitable. Hardnesses from the range about 58 to about 68 Shore D may be used, but above the upper number, the rigidity becomes excessive, to the point where breakage may occur when trying to install the material during cold weather, and below the lower figure the flexibility is such that the material becomes difficult to work with.

Specifications for an exemplary semi-rigid vinyl material which has been found eminently suitable for use in the present invention are set forth in the following table:

Material: Geon B6D00
Generic: Polyvinyl Chloride
Manufacturer: Geon Company

| Property | Data | Units |
|---|---|---|
| GENERAL | | |
| Appearance | Opaque | |
| Features | Gloss, Medium | |
| Processing Method | Extrusion | |
| Recycled | No | |
| PHYSICAL | | |
| Density/Specific Gravity | 1.3900 | sp gr 23/23C |
| HARDNESS | | |
| Durometer (Shore) Hardness | 63 Shore D | |
| THERMAL | | |
| Brittle Temp. | –40 | F |
| Melting Point | 355.0–365.0 | F |
| ELASTOMERS | | |
| Compression Set | 60.00 | % |
| Elongation @ Brk (Elast) | 370.0 | % |

-continued

| Material: Geon B6D00<br>Generic: Polyvinyl Chloride<br>Manufacturer: Geon Company | | |
|---|---|---|
| Property | Data | Units |
| Tensile Modules @ 100% | 670 | psi |
| Tensile Str @ Yid (Elast) | 2900 | psi |
| Tear Strength, Graves | 190.0000 | lb/in |

Another advantage of the exemplary material is that individual strips can be heat welded together during installation, as will be described in greater detail below. It will also be recognized that, in addition to the material described above, other resiliently flexible, semi-rigid plastic materials having suitable characteristics, whether these are extrusion molded or otherwise formed, may occur to those skilled in the art.

d. Installation

Figure 3:
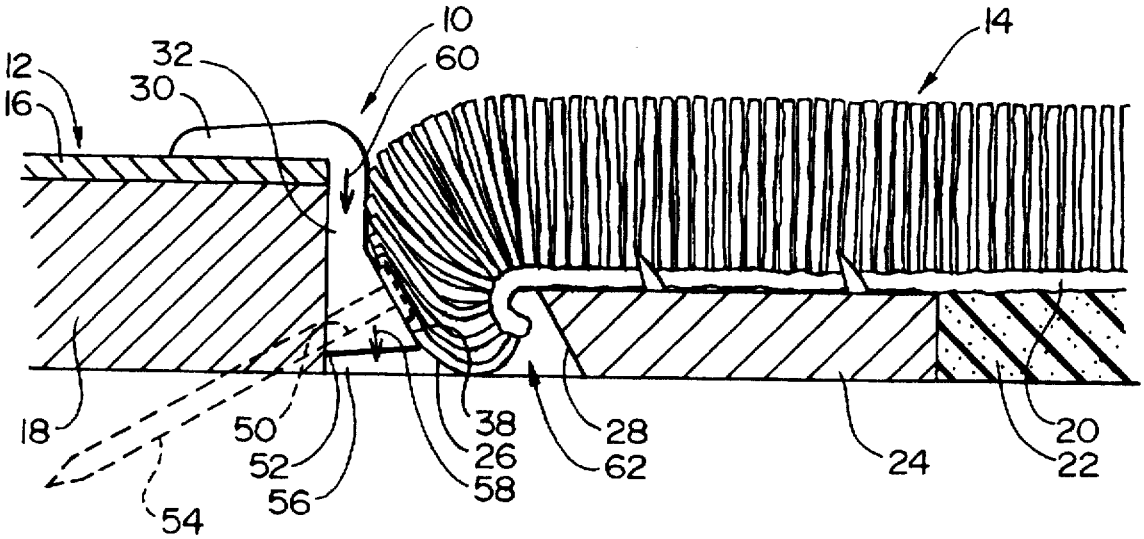
FIG. 3 is an end view of the edge strip installation of FIG. 1, showing the manner in which the fastener alignment bore ensures proper installation of the fasteners and is a secure, tight-fitting installation of the edge strip.

FIG. 3 is a cross-sectional view showing the strip 10 as this is installed using nails or other fasteners, and its relationship with the linoleum and carpeted floor areas.

As is shown in FIG. 3, the bore 50 receives the shank of the nail 54 so that this passes through the lower corner of the underlayment 18 and then enters the plywood subfloor. Because the height of the web section 32 is approximately equal to, and no longer than, the thickness of the underlayment 18 (e.g., ½ inch), the lower corner 52 of the edge strip may just touch the surface of the subfloor, or, when using a ⅝-inch thick underlayment, this may be positioned a slight distance (e.g., ⅛-inch) above the surface of the subfloor. In either installation, the sloped bottom surface ensures that a gap 56 will be formed beneath the footing section. Also, the configuration of the footing section ensures that the exit opening of bores 50 will be positioned a predetermined minimum height (e.g., approximately ⅛th inch) above the bottom edge of the underlayment. The footing section of the strip thus serves to ideally position and align the nail so that this will penetrate the edge of the subfloor at an angle which will help hold this down and in a position in which there is sufficient material to avoid fracturing/chipping the particle board.

As the nail 54 (such as a 1¼-inch ring-shank nail) is driven home through bore 50, the head of the nail comes into contact with the outwardly angled face 38 of the footing section, deforming the resilient material of the latter and forcing it downwardly into gap 56, in the direction indicated by arrow 58. This draws the web section 32 downwardly in the direction indicated by arrow 60, until bottom surface 46 comes up flat with the subfloor, and simultaneously presses the underside of the top flange 30 against the linoleum surface with a predetermined force. The end strip flexes at the radiused section 34 until the upper flange extends parallel to the surface of the linoleum; in this position, the relatively thick material at the radiused section firmly biases the upper flange section against the linoleum to insure a long-lasting, tight fit.

As can also be seen in FIG. 3, the outwardly sloping face 38 of the footing portion of the strip extends generally parallel to the surface of the undercut bevel 28 on the forward edge of the hold down strip 24. The two surfaces thus cooperate to form a channel 62 into which the edge 26 of the carpet can be quickly and tightly tucked during installation.

Figure 4:
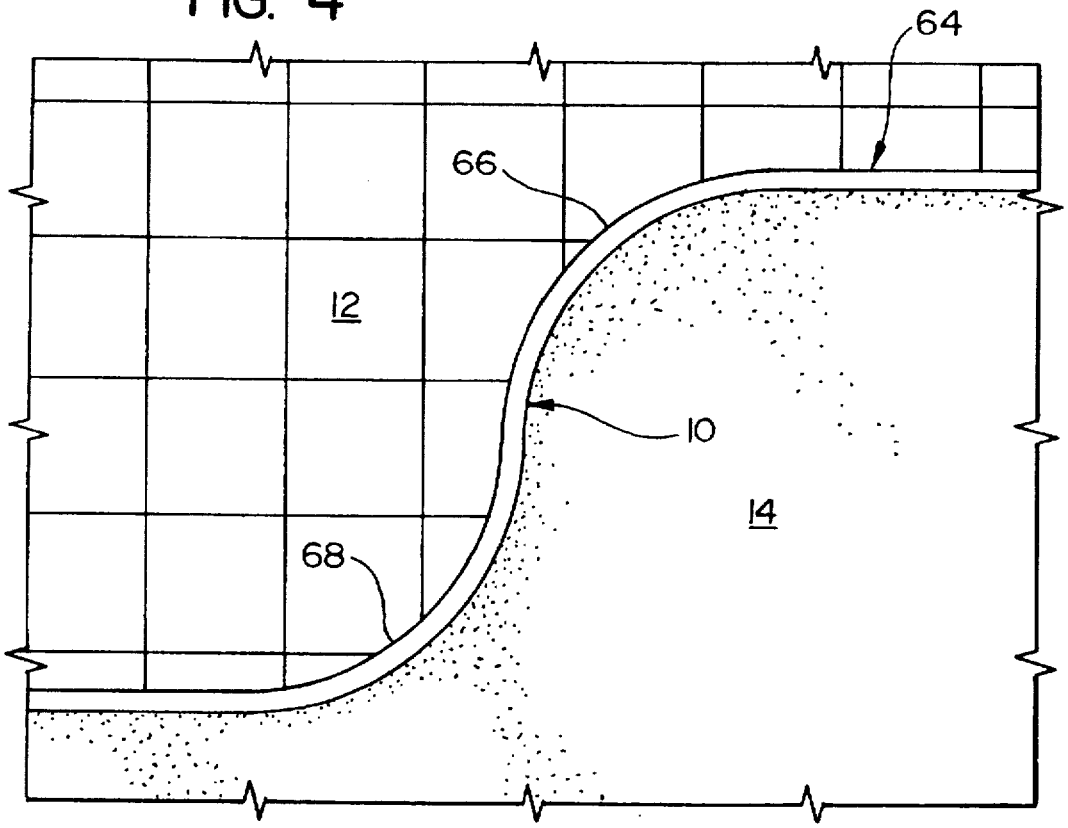
FIG. 4 is a plan view of the edge strip installation of FIGS. 1 and 3; showing the manner in which the edge strip material conforms to a curved-line threshold between the linoleum and carpeted areas.

FIG. 4 presents a plan view of the edge strip 10 in accordance with the present invention installed along a curved threshold 64 between the linoleum and carpeted areas 12, 14. As can be seen, the features of the present invention make it possible to install this along both concave and convex curves, as at 66 and 68 in FIG. 4. Also, by virtue of the low melting point and fusibility of the extruded semi-rigid vinyl material, individual strips can be "butt welded" together using a soldering tip or similar heating apparatus, so as to form a seamless strip for long installations.

In this description, the present invention has generally been illustrated in the context of a threshold between a linoleum and carpeted area. It will be understood, however, that the threshold may be between a linoleum surface area and an area having some other type of floor covering such as tile, hardwood flooring, and so forth.

It is thus to be recognized that various alterations, modifications, and/or additions may be introduced into the constructions and arrangements of parts described above without departing from the spirit or ambit of the present invention as defined by the appended claims.

What is claimed is:

1. An elongate molding strip for installation along a curvilinear transition between first and second floor coverings mounted on a substantially level floor, said molding strip comprising:

a web for extending generally vertically over a rise along an edge of said second floor covering;

a flange mounted to an upper portion of said web for extending generally horizontally over an upper surface of said second floor covering at substantially the same level as an upper surface of said first floor covering, said flange extending forwardly from said web at a slight downward angle and having a width which is selected to permit said flange to flex substantially freely in a generally horizontal plane; and a footing mounted to a lower portion of said web which is configured to draw said web downwardly as fasteners are driven therethrough so as to install said molding strip, said footing having an outer wall which extends at a downward angle from said web so as to form an area of material for receiving a plurality of fasteners which increases in thickness towards a bottom edge of said strip;

said molding strip being formed of a semi-rigid, resiliently flexible material having a hardness which is selected such that said flange is able to yield resiliently against said upper surface of said second floor covering as said web of said strip is drawn downwardly, to a substantially horizontal orientation in which said flange is resiliently biased against said upper surface of said second floor covering, and such that said molding strip is able to flex substantially freely in said horizontal plane so as to conform to said curvilinear transition between said first and second floor coverings without buckling or tearing of said flange or said footing of said strip.

2. The molding strip of claim 1, further comprising:

a corner portion which joins said flange to said vertical web of said strip, said corner portion having a radiused outer surface for minimizing concentration of stress and for enhanced resistance to traffic wear.

3. The molding strip of claim 2, wherein said flange tapers outwardly from a relatively thick base portion at said radiused corner portion to a relatively thin tip portion which extends over said second floor covering, so that said relatively thick base portion has sufficient strength to firmly bias said flange against said upper surface of said second floor covering while said relatively thin tip portion protrudes a minimal distance above said upper surface of said second floor covering.

4. The molding strip of claim 3, wherein said relatively thin tip portion of said flange has a radiused upper surface for enhanced resistance to traffic wear.

5. The molding strip of claim 2, wherein said web and footing of said strip have a combined height which is equal to or less than a total height of said second floor covering above a subfloor to which said second floor covering is mounted.

6. The molding strip of claim 5, wherein said footing of said strip comprises:

an outer face portion which extends outwardly and downwardly from said vertical web so as to form an area of thickened material at said footing for said fasteners to pass through and pull down on said web of said strip without tearing out of said footing.

7. The molding strip of claim 6, wherein said outer face portion of said footing comprises a substantially planar surface which extends outwardly and downwardly from said vertical web at a selected angle.

8. The molding strip of claim 7, wherein said selected angle at which said planar surface extends outwardly and downwardly from said vertical web is substantially perpendicular to a predetermined angle for correct installation of said fasteners, so as to aid in correctly orienting said fasteners for driving through said footing of said molding strip and a lower portion of said second floor covering.

9. The molding strip of claim 8, wherein said footing of said strip further comprises:

a plurality of pre-formed bores extending substantially perpendicularly to said surface for passage of said fasteners therethrough.

10. The molding strip of claim 9, wherein each said bore comprises:

an exit opening having a location which is selected so as to be positioned at a predetermined height above a bottom of said underlayment layer so as to avoid breakage of said underlayment layer as said fasteners are driven therethrough.

11. The molding strip of claim 8, wherein said angle at which said planar surface extends outwardly and downwardly from said web section is furthermore substantially parallel to a predetermined angle at which an undercut section of a carpet hold-down strip slopes inwardly and downwardly where installed proximate said floor edge, so that said footing surface and undercut section define a sloping, parallel-sided channel into which a carpet edge can be tucked during installation.

12. The molding strip of claim 11, wherein said angle at which said planar surface slopes downwardly and rearwardly from said web of said strip is approximately 30° from vertical.

13. The molding strip of claim 8, wherein said footing of said strip further comprises:

a bottom surface which slopes upwardly and rearwardly at a predetermined angle so as to form a gap above said subfloor which permits said footing to deform downwardly during installation of a fastener therethrough so as to assist in drawing said web of said strip downwardly as said fasteners are driven through said footing.

14. The molding strip of claim 13, wherein said predetermined angle at which said bottom surface of said footing extends upwardly and rearwardly is substantially parallel to said slight downward angle at which said flange extends forwardly from said web of said strip.

15. The molding strip of claim 14, wherein said angles at which said flange and said bottom surface of said footing extend are approximately 5° from horizontal.

16. The molding strip of claim 5, wherein said semi-rigid, resiliently flexible material is extrusion-formed semi-rigid vinyl material.

17. The molding strip of claim 16, wherein said semi-rigid vinyl material has a predetermined rigidity in the range from about 58 Shore D to about 68 Shore D.

18. The molding strip of claim 17, wherein said flange has a width which is approximately equal to said combined height of said web and footing of said strip.

19. The molding strip of claim 18, wherein said semi-rigid vinyl material has a predetermined rigidity in the range from about 62 Shore D to about 66 Shore D.

20. The molding strip of claim 17, wherein said width of said flange and said combined height of said web and footing of said strip are each approximately equal to 0.5 inch.

21. The molding strip of claim 20, wherein said semi-rigid vinyl material has a predetermined rigidity of about 63 Shore D.

22. An elongate molding strip for installation along a curvilinear transition between first and second floor coverings mounted on a substantially level floor, said molding strip comprising:

a web for extending generally vertically over a rise along an edge of said second floor covering;

a flange mounted to an upper portion of said web for extending generally horizontally over an upper surface of said second floor covering, said flange extending forwardly from said web at a slight downward angle; said flange tapering outwardly from a relatively thick base portion to a relatively thin tip portion which extends over second floor surface, so that said relatively thick base portion has sufficient strength to firmly bias said flange against said second floor covering while said relatively thin tip portion protrudes a minimal distance above said second floor covering;

a corner portion which joins said base portion of said flange to said vertical web of said strip, said corner portion having a smoothly radiused outer surface; and a footing mounted to a lower portion of said web for receiving a plurality of fasteners, said footing being configured to draw said web downwardly as fasteners are driven therethrough so as to install said molding strip, said web and footing having a combined height which is equal to or less than a total height of said, second floor covering including said vertical rise thereof above a subfloor to which said second floor covering is mounted, said footing comprising:

a substantially planar outer surface which extends outwardly and downwardly from said vertical web at a selected angle approximately 30° from vertical so as to form an area of thickened material at said footing, said selected angle at which said planar surface extends outwardly and downwardly from said vertical web being substantially perpendicular to a predetermined angle for correct installation of said fasteners, so as to aid in correctly orienting said fasteners for driving through said footing of said molding strip and a lower portion of said second floor covering;

a plurality of pre-formed bores extending substantially perpendicularly to said planar surface for passage of said fasteners therethrough, each said bore having an exit opening at a location which is selected so as to be positioned at a predetermined height above a bottom of said second floor covering so as to avoid breakage of a lower portion of said second floor covering as said fasteners are driven therethrough; and a bottom surface which slopes upwardly and rearwardly at a predetermined angle so as to form a gap above said subfloor which permits said footing to deform downwardly during installation of a fastener therethrough so as to assist in drawing said web of said strip downwardly as said fasteners are driven through said footing, said predetermined angle at which said bottom surface of said footing extends upwardly and rearwardly being substantially parallel to said slight downward angle at which said flange extends forwardly from said web;

said molding strip being formed of a semi-rigid, resiliently flexible material having a selected hardness such that said flange is able to yield resiliently against said second floor covering as said web is drawn downwardly, to a substantially horizontal orientation in which said flange is resiliently biased against said upper surface of said second floor covering, and such that said molding strip is able to bend in a horizontal plane so as to conform to said curvilinear transition between said first and second floor coverings without buckling or tearing of said flange or said footing of said strip, said semi-rigid, resiliently flexible material being an extrusion-formed semi-rigid vinyl material having a predetermined rigidity in the range from about 58 Shore D to about 68 Shore D.

23. An elongate molding strip for installation along a curvilinear transition between first and second floor coverings mounted on a substantially level floor, said molding strip comprising:

a web for extending generally vertically over a rise along an edge of said second floor covering;

a flange mounted to an upper portion of said web for extending generally horizontally over an surface of said second floor covering, said flange extending forwardly from said web at a slight downward angle and having a corner portion which joins said horizontal flange to said vertical web of said strip, said corner portion having a radiused outer surface for minimizing concentration of stress and for enhanced resistance to traffic wear; and a footing mounted to a lower portion of said web for receiving a plurality of fasteners, said footing being configured to draw said web downwardly as fasteners are driven therethrough so as to install said molding strip, said footing further having a substantially planar outer face portion which extends outwardly and downwardly from said vertical web at a predetermined angle so as to form an area of thickened material at said footing;

said selected angle at which said planar surface extends outwardly and downwardly from said vertical web being substantially perpendicular to a predetermined angle for correct installation of said fasteners, so as to aid in correctly orienting said fasteners for driving through said footing portion of said molding strip and a lower portion of said second floor covering, said footing further having a plurality of pre-formed bores extending substantially perpendicularly to said surface for passage of said fasteners therethrough wherein said web and footing have a combined height which is equal to or less than a total height of said second floor covering, including said vertical rise thereof; and said molding strip being formed of a semi-rigid, resiliently flexible material having a selected hardness such that said flange is able to yield resiliently against said second floor covering as said web of said strip is drawn downwardly, to a substantially horizontal orientation in which said flange is resiliently biased against said upper surface of said second floor covering, and such that said molding strip is able to bend in a horizontal plane so as to conform to said curvilinear transition between said first and second floor coverings without buckling or tearing of said flange or said footing of said strip.

24. The molding strip of claim 23, wherein each said bore comprises:

an exit opening having a location which is selected so as to be positioned at a predetermined height above a bottom of said second floor covering so as to avoid breakage of a lower portion of said second floor covering as said fasteners are driven therethrough.

25. The molding strip of claim 23, wherein said angle at which said planar surface extends outwardly and downwardly from said web is furthermore substantially parallel to a predetermined angle at which an undercut section of a carpet hold-down strip slopes inwardly and downwardly where installed proximate said floor edge, so that said footing surface and undercut section define a sloping, parallel-sided channel into which a carpet edge can be tucked during installation.

26. An elongate molding strip for installation along a curvilinear transition between first and second floor coverings mounted on a substantially level floor, said molding strip comprising:

a web for extending generally vertically over a rise along an edge of said second floor covering;

a flange mounted to an upper portion of said web for extending generally horizontally over an upper surface of said second floor covering, said flange extending forwardly from said web at a slight downward angle and having a corner portion which joins said flange to said vertical web of said strip, said corner portion having a radiused outer surface for minimizing concentration of stress and for enhanced resistance to traffic wear; and a footing mounted to a lower portion of said web for receiving a plurality of fasteners, said footing being configured to draw said web downwardly as fasteners are driven therethrough so as to install said molding strip, said footing further having a substantially planar outer face portion which extends outwardly and downwardly from said vertical web so as to form an area of thickened material at said footing, said selected angle at which said planar surface extends outwardly and downwardly from said vertical web being substantially perpendicular to a predetermined angle for correct installation of said fasteners, so as to aid in correctly orienting said fasteners for driving through said footing of said molding strip and a lower portion of said second floor covering, said footing further comprising a bottom surface which slopes upwardly and rearwardly at a predetermined angle so as to form a gap above a subfloor to which said second floor covering is mounted, which permits said footing to deform downwardly during installation of a fastener therethrough so as to assist in drawing said web of said strip downwardly as said fasteners are driven through said footing, said molding strip being formed of a resiliently flexible, extrusion-formed, semi-rigid vinyl material having a selected hardness such that said flange is able to yield resiliently against said second floor covering as said web is drawn downwardly, to a substantially horizontal orientation in which said flange is resiliently biased against said upper surface of said second floor covering, and such that said molding strip is able to bend in a horizontal plane so as to conform to said curvilinear transition between said first and second floor coverings without buckling or tearing of said flange or said footing of said strip.

27. The molding strip of claim 26, wherein said predetermined angle at which said bottom surface of said footing extends upwardly and rearwardly is substantially parallel to said slight downward angle at which said flange portion extends forwardly from said web portion.

28. The molding strip of claim 27, wherein said angles at which said upper flange and said bottom surface of said footing extend are approximately 5° from horizontal.

* * * * *